US006619067B2

(12) United States Patent
Hiramatsu

(10) Patent No.: US 6,619,067 B2
(45) Date of Patent: Sep. 16, 2003

(54) COOLING UNIT

(75) Inventor: Shinya Hiramatsu, Aichi-ken (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/162,744

(22) Filed: Jun. 6, 2002

(65) Prior Publication Data

US 2002/0184910 A1 Dec. 12, 2002

(51) Int. Cl.[7] ..... F25C 1/14
(52) U.S. Cl. ..... 62/354; 165/133
(58) Field of Search ..... 62/354; 165/94, 165/133

(56) References Cited

U.S. PATENT DOCUMENTS 4,739,630 A * 4/1988 Tandeski et al. ..... 62/354

FOREIGN PATENT DOCUMENTS

JP 11-132610 5/1999

* cited by examiner

*Primary Examiner*—William E. Tapolcai
(74) *Attorney, Agent, or Firm*—Rader, Fishman & Grauer PLLC

(57) ABSTRACT

A cooling unit adapted for use in an auger type ice making machine, a freezing mechanism of an ice cream making machine or the like, composed of a metallic cylindrical evaporator housing and a metallic freezing pipe helically wound around the evaporator housing through a metallic filler for thermal contact with the evaporator housing, the metallic filler being embedded in a space between the evaporator housing and the freezing pipe, wherein the entirety of the freezing pipe is covered with a metallic surface layer membrane formed thereon.

7 Claims, 2 Drawing Sheets

COOLING UNIT

BACKGROUND OF THE INVENTION

1. Field of the Invention

The present invention relates to a cooling unit adapted for use in an ice making mechanism of an auger type ice maker, a freezing mechanism of an ice cream making machine or a freezing mechanism of the other type cooling equipment.

2. Description of the Prior Art

Disclosed in Japanese Patent Laid-open Publication No. 11(1999)-132610 is a cooling unit used in a ice making mechanism of an auger type ice maker, wherein a metallic freezing pipe is helically wound around the outer periphery of a metallic cylindrical evaporator housing through a metallic filler for thermal contact with the evaporator housing. In the cooling unit, the metallic filler is embedded in a helical space between the evaporator housing and the freezing pipe to enhance the heat-exchange efficiency of the cooling unit.

It is, however, difficult to completely deposit the metallic filler into the helical space between the evaporator housing and the freezing pipe. If the metallic filler is partly chipped, an undesired space is inevitably formed between the evaporator housing and the freezing pipe. In addition, if the metallic filler causes corrosion of the evaporator housing at its embedded portion, there will occur an undesired space at the corroded portion of the evaporator housing. In such an instance, water entered into the space from the exterior is repeatedly frozen and melted in operation and stopping of the cooling unit. This results in enlargement of the undesired space between the evaporator housing and the freezing pipe and progress of the corrosion of the evaporator housing. The enlargement of undesired space in communication with the exterior deteriorates the cooling performance of the unit. If the evaporator housing is squeezed by the repetitive freeze and melting of the water, the cooling performance of the unit is further deteriorated by deformation of the evaporator housing.

SUMMARY OF THE INVENTION

It is, therefore, a primary object of the present invention to provide a cooling unit capable of overcoming the problems discussed above.

According to the present invention, there is provided a cooling unit composed of a metallic cylindrical evaporator housing and a metallic freezing pipe helically wound around the evaporator housing through a metallic filler for thermal contact with the evaporator housing, wherein the entirety of the helical freezing pipe is covered with a metallic surface layer membrane formed thereon.

In a practical embodiment of the cooling unit, the evaporator housing is made of stainless steel, the freezing pipe is made of copper, and the metallic filler is in the form of solder injected in a melted condition into a space between the evaporator housing and freezing pipe and embedded in the space in a solid condition. In this embodiment, the metallic surface layer membrane is in the form of a surface layer membrane of tin sprayed in a melted condition to the outer periphery of the freezing pipe in entirety.

In the cooling unit according to the present invention, the metallic surface layer membrane is useful to completely insulate the embedded metallic filler from the exterior. This is effective to restrain entry of the water into a space inevitably formed in the embedded portion of the metallic filler and to restrain corrosion of the metallic filler in contact with the evaporator housing. In addition, even if an undesired space in the embedded portion of the metallic filler is enlarged during a long period of time, communication of the enlarged space with the exterior is blocked by the surface layer membrane. Thus, the cooling performance of the unit is maintained in a good condition for a long period of time.

In the case that the evaporator housing is made of stainless steel, the freezing pipe is made of copper, the metallic filler is in the form of solder embedded in a space between the evaporator housing and freezing pipe and the surface layer membrane is in the form of a surface layer membrane of tin, the surface layer membrane of tin acts as a sacrifice anode to the freezing pipe, of copper to prevent leakage of refrigerant caused by corrosion of the freezing pipe.

DESCRIPTION OF THE PREFERRED EMBODIMENT

Figure 1:
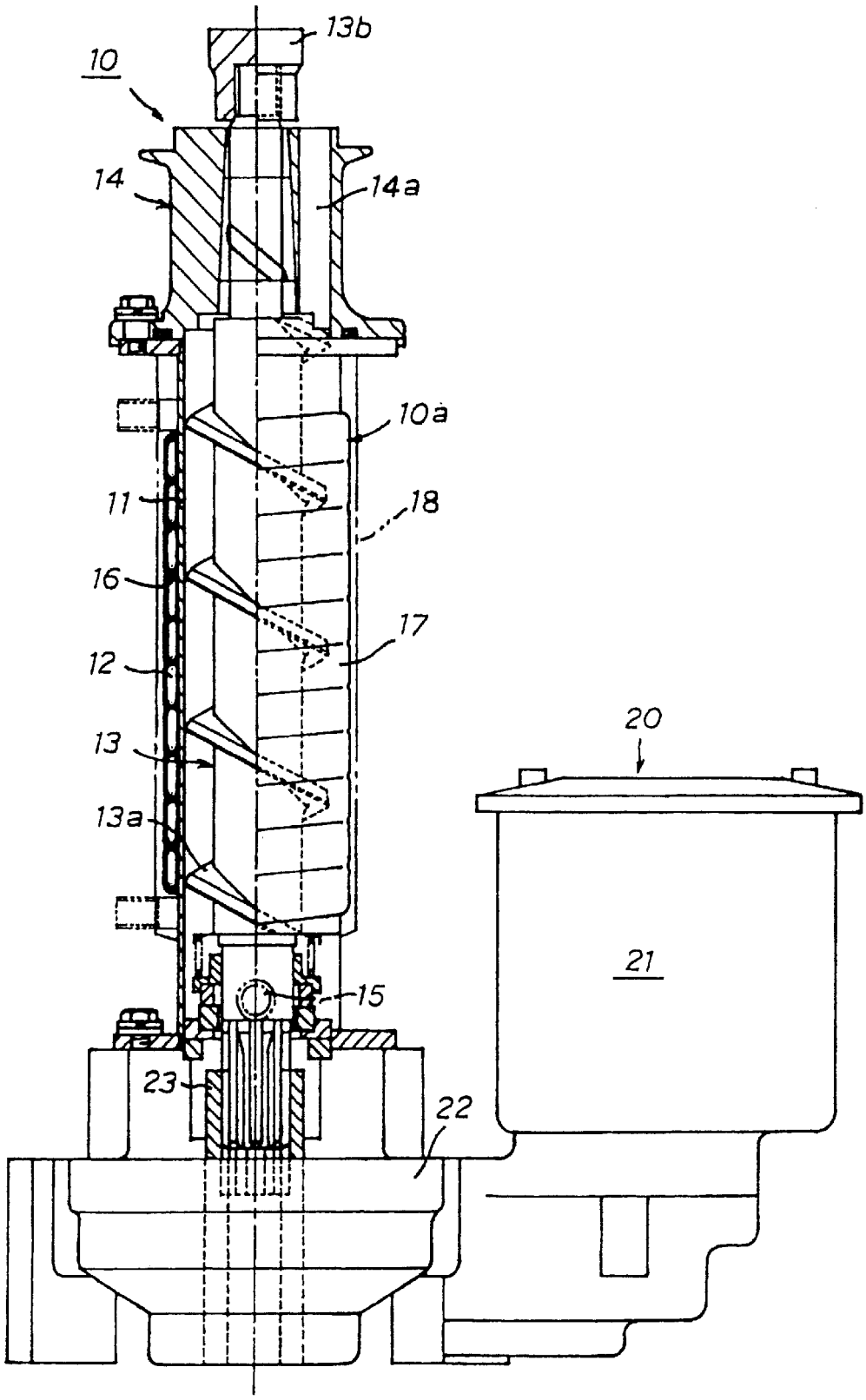
FIG. 1 is a partly broken vertical sectional view of an auger type ice maker in accordance with the present invention.

Illustrated in FIG. 1 of the drawings is an auger type ice maker the ice making mechanism of which is equipped with a cooling unit in accordance with the present invention.

The ice maker is composed of an ice making mechanism 10 and a drive mechanism 20. The ice making mechanism 10 includes a cooling unit 10*a* composed of a cylindrical evaporator housing 11 formed to contain an auger 13 and a freezing pipe 12 helically wound around the evaporator housing 11. The drive mechanism 20 includes an electric motor 21, a speed reduction gear train 22 and an output shaft 23 drivingly connected to the electric motor 21 through the speed reduction gear train 22. The auger 13 is mounted for rotary movement within the evaporator housing 11 and connected at its lower end to the output shaft 23 of the drive mechanism 20. The upper end of auger 13 is rotatably supported by means of an extrusion head 14 mounted on the upper end of evaporator housing 11, and a cutter 13*b* is mounted on the upper end of auger 13 for rotation therewith.

In operation of the ice maker, fresh water for ice is supplied into the evaporator housing 11 from an inlet port 15 and stored in the evaporator housing 11 at a predetermined level, while the electric motor 21 is activated to rotate the auger 13. The supplied fresh water is chilled by refrigerant flowing through the freezing pipe 12 to form ice crystals on the internal surface of evaporator housing 11. The ice crystals are scraped by a helical blade 13*a* of auger 13, and the scraped ice crystals are advanced upward toward the upper end of evaporator housing 11 and compressed in the course of passing through compression passages 14*a* of extrusion head 14. The compressed ice crystals are continuously extended in the form of rods of dehydrated ice from the compression passages 14*a* of extrusion head 14 and broken by the cutter 13*b* into ice pieces. Thus, the ice pieces are discharged from a discharge duct (not shown) of the ice maker.

Figure 2:
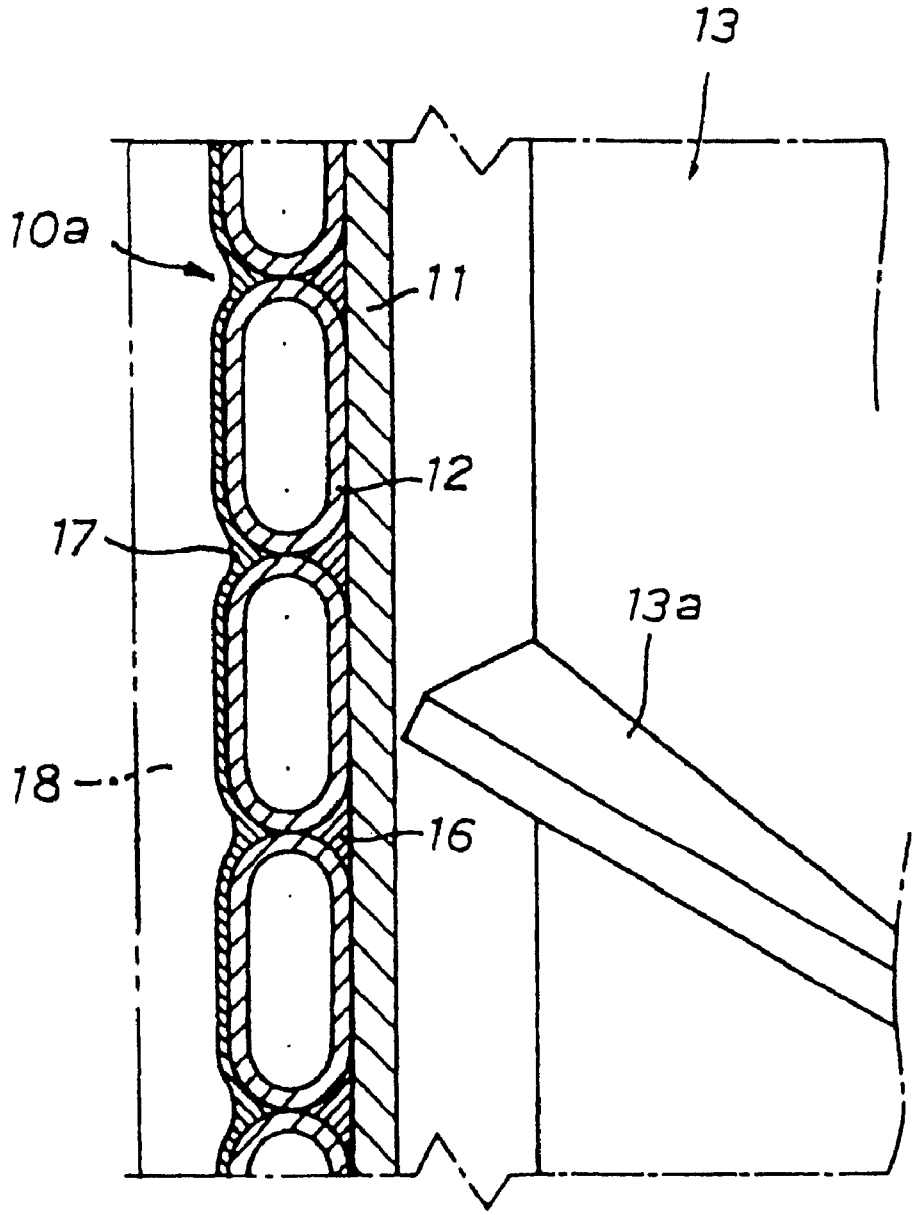
FIG. 2 is an enlarged vertical sectional view of a cooling unit shown in FIG. 1.

In the cooling unit 10*a* of the ice making mechanism 10, the evaporator housing 11 is in the form of a cylindrical body made of stainless steel, and the freezing pipe 12 is made of copper. As illustrated in FIG. 2, the freezing pipe 12 is helically wound around the evaporator housing 11 in a closed relationship, and a metallic filler 16 is embedded in a helical space between the evaporator housing 11 and freezing pipe 12. The entirety of the freezing pipe 12 is covered with a metallic surface layer membrane 17 formed thereon. In addition, the cooling unit 10*a* is covered with a heat insulation material 18 in a usual manner.

The metallic filler 16 is in the form of solder injected in a melted condition into the helical space between the evaporator housing 11 and freezing pipe 12 and embedded in the helical space in a solid condition. In this case, it is preferable that solder containing by weight 96.5% Sn and 3.5% Ag or solder containing by weight 95.5% Sn, 3.5% Ag and 1.0% Cu is used as the metallic filler 16. It is also desirable that the surface layer membrane 17 is in the form of a surface layer membrane of tin (100% by weight) sprayed in a melted condition to the outer periphery of freezing pipe 12 in entirety.

In the cooling unit 10*a,* the metallic filler 16 embedded in the helical space between the evaporator housing 11 and freezing pipe 12 is useful to enhance the heat transfer efficiency from the freezing pipe 12 to the evaporator housing 11. The surface layer membrane 17 is useful to completely insulate the embedded metallic filler 16 from the exterior and acts as a sacrifice anode to the metallic filler 16. This is effective to restrain entry of water into a space inevitably formed in the embedded portion of the metallic filler 16 and to restrain corrosion of the metallic filler 16 in contact with the evaporator housing 11. In addition, even if an undesired space in the embedded portion of the metallic filler 16 is enlarged during a long period of time, communication of the enlarged space with the exterior is blocked by the surface layer membrane 17. Thus, the cooling performance of the unit 10*a* is maintained in a good condition for a long period of time.

What is claimed is:

1. A cooling unit, comprising:

a metallic cylindrical evaporator housing;

a metallic freezing pipe helically wound around an outer surface of the evaporator housing with consecutive turns of the metallic freezing pipe in contact with one another to form an interior space defined by the contacting turns and the outer surface of the evaporator housing; and a metallic filler for thermal contact with the evaporator housing and the metallic freezing pipe, the metallic filler being embedded in the interior space, wherein an entirety of an exterior surface of the freezing pipe being covered with a metallic surface layer membrane formed thereon, the metallic surface layer membrane being in isolation from the metallic filler.

2. A cooling unit as claimed in claim 1, wherein the evaporator housing is in the form of a cylindrical body made of stainless steel, and the freezing pipe is made of copper.

3. A cooling unit as claimed in claim 1, wherein the metallic filler is in the form of metal injected in a melted condition into the space between evaporator housing and the freezing pipe and embedded in the space in a solid condition.

4. A cooling unit as claimed in claim 1, wherein the metallic filler is in the form of solder injected in a melted condition into the space between evaporator housing and the freezing pipe and embedded in the space in a solid condition.

5. A cooling unit as claimed in claim 1, wherein the surface layer membrane is in the form of a surface layer membrane of metal sprayed to the exterior surface of the freezing pipe in entirety.

6. A cooling unit as claimed in claim 1, wherein the surface layer membrane is in the form of a layer membrane of tin sprayed to the exterior surface of the freezing pipe in entirety.

7. A cooling unit adapted for use in an auger type ice making machine, comprising:

a metallic cylindrical evaporator housing;

a metallic freezing pipe helically wound around an outer surface of the evaporator housing with consecutive turns of the metallic freezing pipe in contact with one another to form an interior space defined by the contacting turns and the outer surface of the evaporator housing; and a metallic filler for thermal contact with the evaporator housing and the metallic freezing pipe, the metallic filler being embedded in the interior space, wherein an entirety of an exterior surface of the freezing pipe being covered with a metallic surface layer membrane formed thereon, the metallic surface layer membrane being in isolation from the metallic filler.

* * * * *